US007527526B1

(12) United States Patent
Chen et al.

(10) Patent No.: US 7,527,526 B1
(45) Date of Patent: May 5, 2009

(54) ELECTRICAL CONNECTOR

(75) Inventors: Li-Sen Chen, Taoyuan Hsien (TW); Hua-Chun Chang, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 12/003,566

(22) Filed: Dec. 28, 2007

(51) Int. Cl.
*H01R 13/648* (2006.01)

(52) U.S. Cl. ..... 439/607

(58) Field of Classification Search ..... 439/607, 439/660, 608
See application file for complete search history.

(56) References Cited

U.S. PATENT DOCUMENTS 5,017,156 A 5/1991 Sugiyama
5,266,038 A * 11/1993 Nakamura ..... 439/79
6,095,837 A * 8/2000 David et al. ..... 439/188
6,280,209 B1 * 8/2001 Bassler et al. ..... 439/101
7,402,080 B2 * 7/2008 Xiao et al. ..... 439/607

* cited by examiner

*Primary Examiner*—Neil Abrams
*Assistant Examiner*—Phuong Nguyen
(74) *Attorney, Agent, or Firm*—Muncy, Geissler, Olds & Lowe, PLLC

(57) ABSTRACT

An electrical connector being adapted to be matched with a complementary device, and comprising at least an insulating housing, a terminal set and a shielding case. The shielding case substantially surrounds the insulating housing and the terminal set, the shielding case comprising at least a body and a back case. The body of the shielding case surrounds the upper, lower, left and right sides of the insulating housing, and the back case of the shielding case surrounds the back of the insulating housing substantially. The invention providing at least a stopping mechanism to apply a pressing force on the insulating housing, and the direction of the pressing force is opposite to what the complementary device plugging in.

7 Claims, 4 Drawing Sheets

ELECTRICAL CONNECTOR

BACKGROUND

1. Field of Invention

The present invention relates to an electrical connector. More particularly, the present invention relates to an electrical connector with a stopping mechanism.

2. Description of Related Art

Please refer to FIG. 1, an electrical connector of the prior art, the U.S. Pat. No. 5,017,156, an electrical connector is disclosed. The electrical connector comprises a plurality of L-shaped contact pieces 2, a contact piece supporting member 1, and a frame 3 surrounding the L-shaped contact pieces 2. The L-shaped contact piece 2 comprises a terminal portion 15 and a horizontal portion 16 extended and turned therein. A contact 17 is extended from the horizontal portion 16. The contact piece supporting member 1 comprises a body 4 holding part of the terminal portion 15. The frame 3 comprises a casing portion 20, a U-shaped portion 21 and a flat plate portion 22. The casing portion 20 surrounds the entire circumference of the body 4 of the contact piece supporting member 1 and the horizontal portion 16 extended from the body 4. The U-shaped portion 21 is formed at the back of the casing portion 20 and surrounds the upper, left and right sides of the body 4. The flat plate portion 22 is formed at the back of the upper plate and bent therein to surround the back of the body 4.

A holding structure or a stopping mechanism is disclosed in one of the embodiments of the prior art. Engagement pieces, such as engagement holes, are disposed at two sides of the flat plate portion 22. Leg portions are disposed at the complementary position of the U-shaped portion 21. Cut raised engagement pieces are disposed at the leg portions to match the engagement holes to hold the flat plate portion 22 at the back of the U-shaped portion 21. Therefore, the frame 3 surrounds the L-shaped contact pieces 2 and the contact piece supporting member 1 to provide shielding.

However, the bending angle of the flat plate portion 22 is almost 90° which leaves a large interval between the frame 3 and the contact piece supporting member 1. The large interval causes loosening between the frame 3 and the contact piece supporting member 1. Besides, when a complementary device plugs in, the weak strength at the plug-in direction of the electrical connector of the prior art is not good for stable electrical connection or plugging in and pulling out for several times.

SUMMARY

This invention discloses an electrical connector with a stopping mechanism to reduce loose due to an interval between a shielding case and an insulating housing.

The electrical connector in the invention being adapted to be matched with a complementary device comprises at least an insulating housing, a terminal set and a shielding case. The terminal set is disposed in the insulating housing and is electrically connected with complementary terminals of the complementary device. The shielding case surrounds the insulating housing for shielding. A space is disposed between the shielding case and the insulating housing. The space is to receive at least part of the complementary device. The shielding case includes a body and a back case. The body of the shielding case substantially surrounds upper, lower, left and right sides of the insulating housing. The back case of the shielding case is bent from the rear end of the upper side of the body to surrounds the rear end of the insulating housing. A holding structure is disposed at the back case of the shielding case to improve the strength of the structure of the electrical connector. A stopping mechanism is disposed at the back case of the shielding case. The stopping mechanism applies a pressing force on the insulating housing, and the direction of the pressing force is opposite to the direction, which the complementary device plugging in, to avoid loosening between the shielding case and the insulating housing.

In some embodiments of this invention, the right and the left sides of the back case is bent forwardly to form two wings respectively.

In other embodiments of this invention, the holding structure includes a holding hole and a holding emboss. The holding hole is disposed at the wings of the right or left side of the back case, and the holding emboss is disposed at the complementary position of the body.

In some other embodiments of this invention, the stopping mechanism is a stopping flexible arm cut and bent from the back case, and contacting against the back of the insulating housing.

In still another embodiments of this invention, an emboss is disposed at the end of the stopping flexible arm to strengthen the pressing force to the insulating housing.

Therefore, the electrical connector of this invention provides a stopping mechanism to apply a pressing force on the insulating housing to keep the shielding case and the insulating housing at the destined relative position to avoid loosing.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
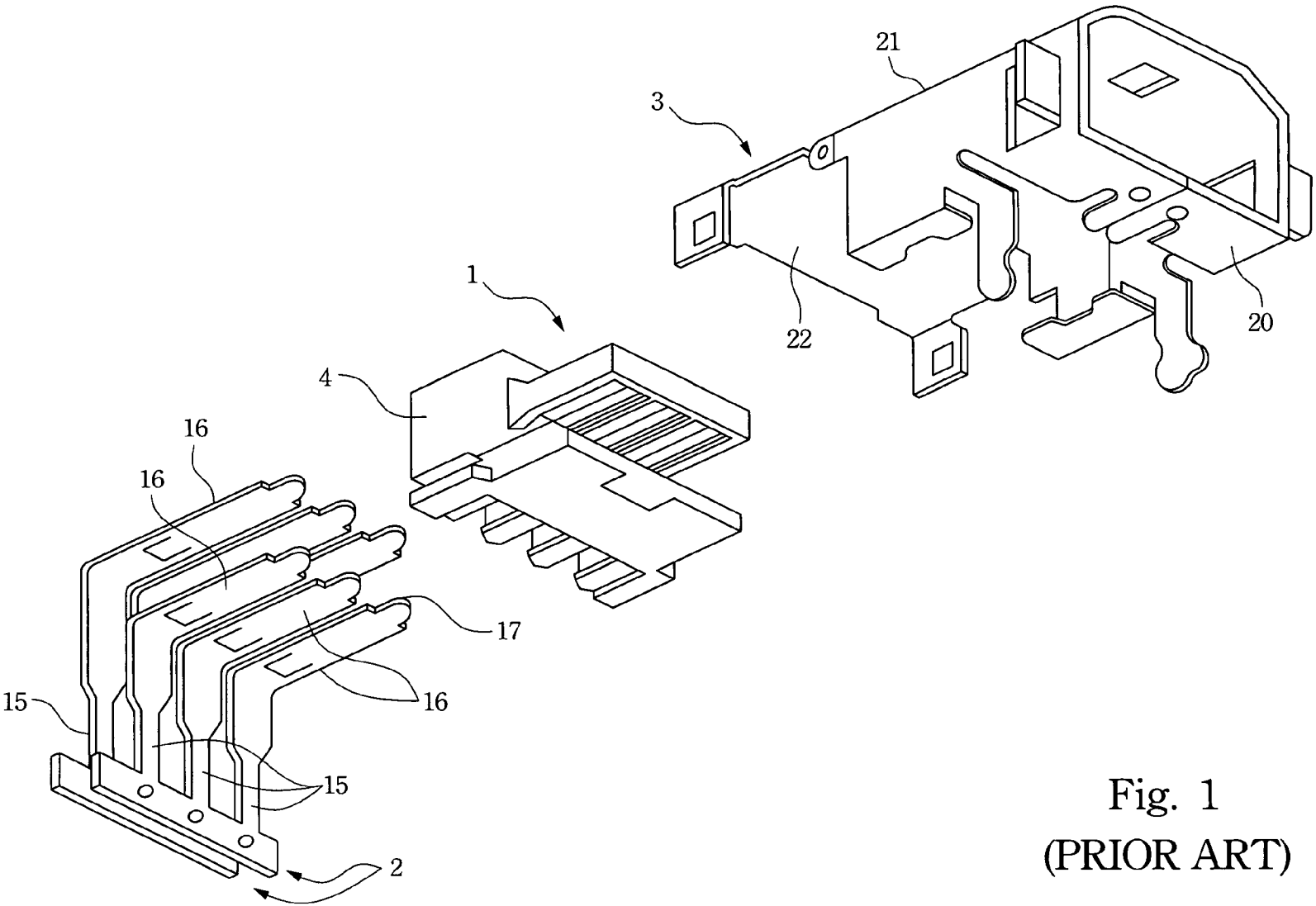
Fig. 1 (PRIOR ART)
FIG. 1 is an electrical connector of the prior art.

Reference will now be made in detail to the present embodiments of the invention, examples of which are illustrated in the accompanying drawings. Wherever possible, the same reference numbers are used in the drawings and the description to refer to the same or like parts.

The electrical connector of the invention disposes a stopping mechanism to reduce loosing caused by the interval between the shielding case and the insulating housing.

Figure 2:
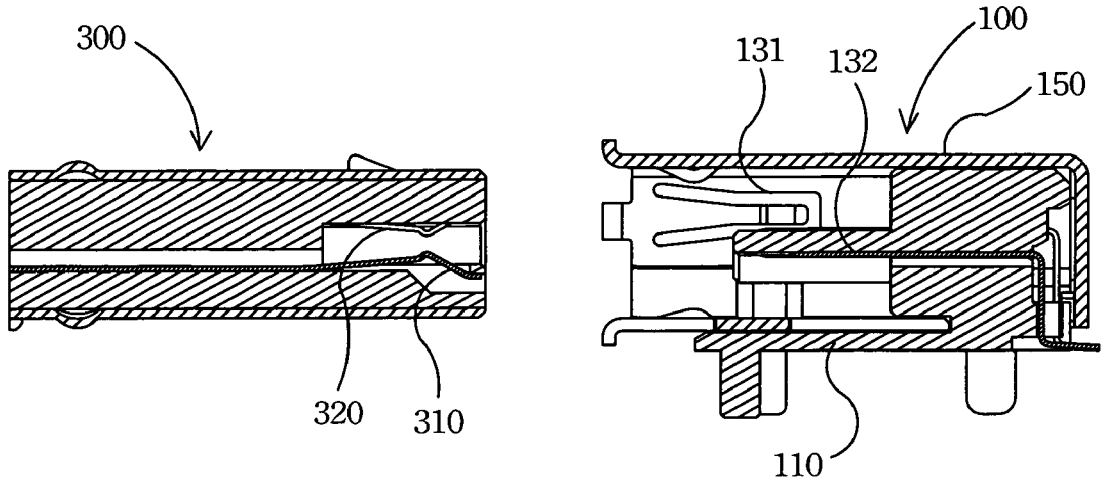
FIG. 2 is the electrical connector according to one embodiment of this invention plugging in an electrical device.
Figure 3:
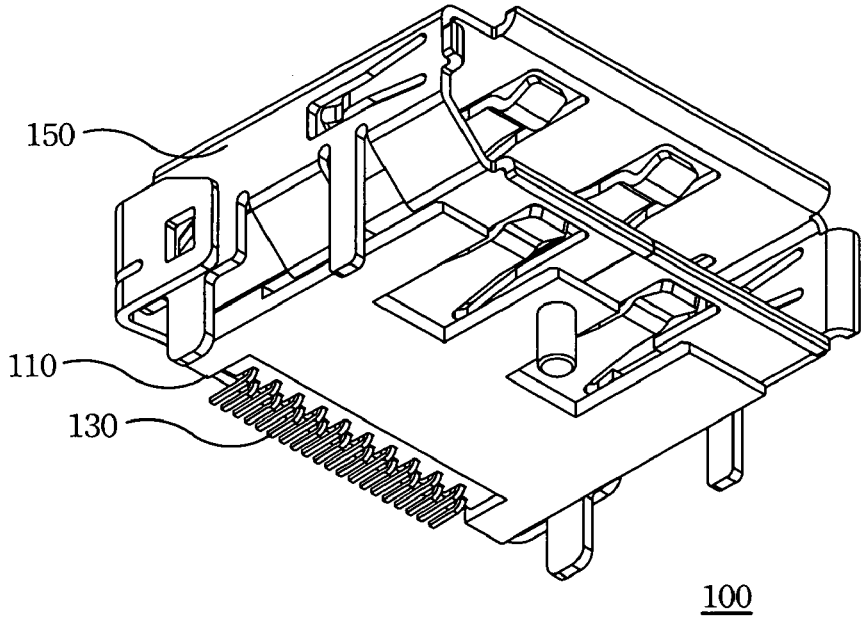
FIG. 3 is a three dimensional view of the electrical connector according to one embodiment of this invention.
Figure 4:
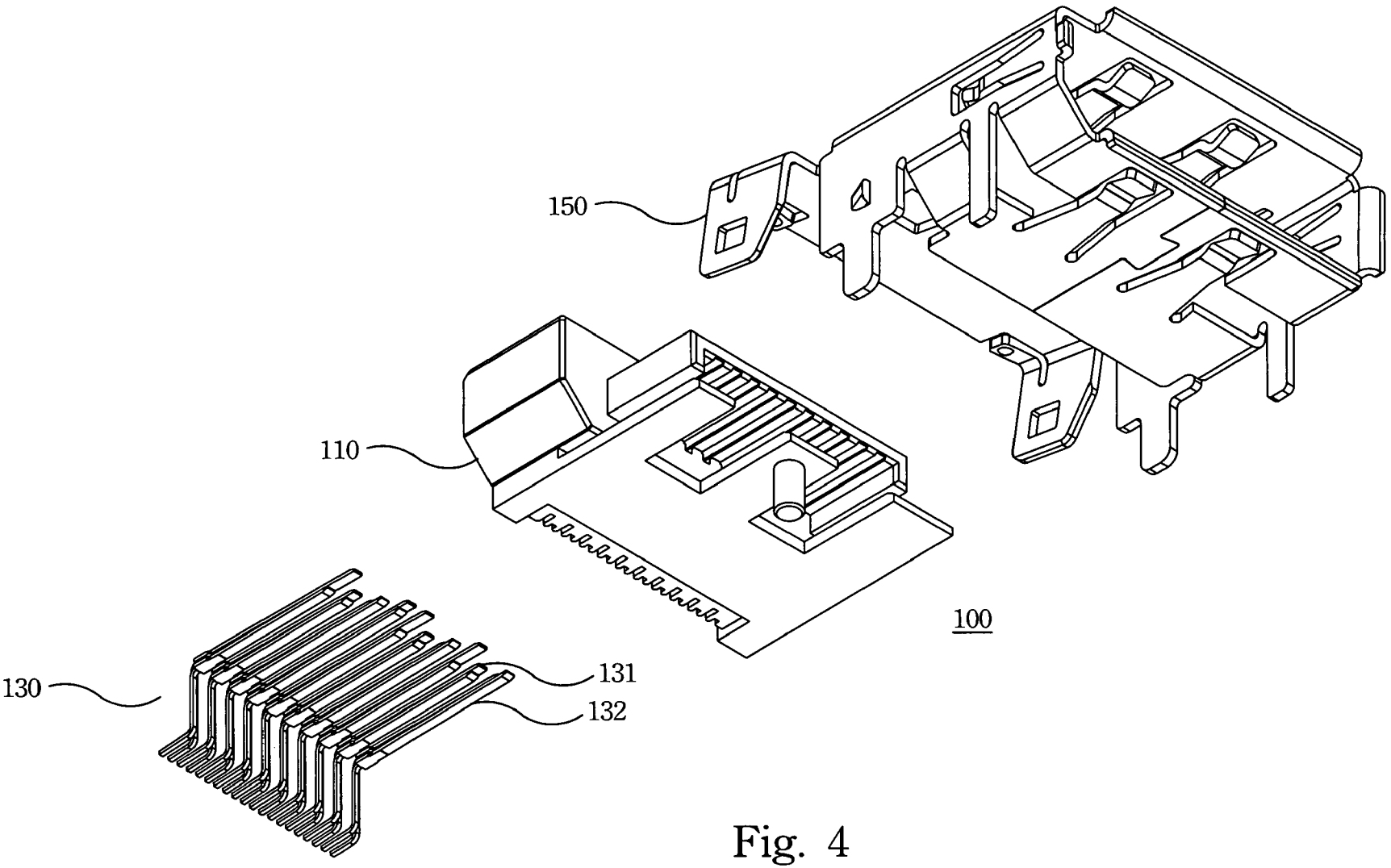
FIG. 4 is an exposed view of the electrical connector according to one embodiment of this invention.

FIG. 2 illustrates an electrical connector plugging in a complementary device in this invention, FIG. 3 illustrates a three dimensional view of the electrical connector in this invention, and FIG. 4 illustrates an exposed view of the electrical connector according to one embodiment of this invention. Referring to FIG. 2, FIG. 3 and FIG. 4 simultaneously, an embodiment of this invention disposes an electrical connector 100, comprising an insulating housing 110, a plurality of terminal sets 130 and a shielding case 150. The insulating housing 110 is a container made of insulating materials, such as plastic. The terminals of the terminal sets are disposed partially in the insulating housing 110, and the other parts of the terminals are exposed outside of the insulating housing 110 for electrical connection. For example, the electrical connector 100 in this invention, adapted to be matched with a complementary device, is a socket connector, and the complementary device 300 is a plug connector. In detail, each terminal set 130 comprises a ground terminal 131 and a pair of differential signal terminals 132. The ground terminal 131 is connected with a complementary ground terminal 310 of the complementary device 300. The differential signal terminals 132 are connected with corresponding complementary differential signal terminals 320 of the complementary device 300 respectively. In practice, the number of the terminals can be adjusted if needed.

An electrically conductive thin material, such as a metal sheet, is cut and bent to form the shielding case 150. The shielding case 150 substantially surrounds the insulating housing 110 to hold the insulating housing 110 and the terminal sets 130 therein. The insulating housing 110 holds and prevents the terminals of the terminal sets 130 from being in contact with the shielding case 150. Therefore, the shielding case 150 provides shielding to the terminals of the terminal sets 130. A space is disposed between the shielding case 150 and the insulating housing 110. The space can receive part of the complementary device 300. In practice, the space is disposed with the proper size, and the complementary device 300 is held between the inner part of the shielding case 150 and the outer part of the insulating housing 110 when the complementary device 300 is plugged into the space. Therefore, the electrical connector 100 of the embodiment and the complementary device 300 are connected tightly to keep the transmitting quality.

Figure 5:
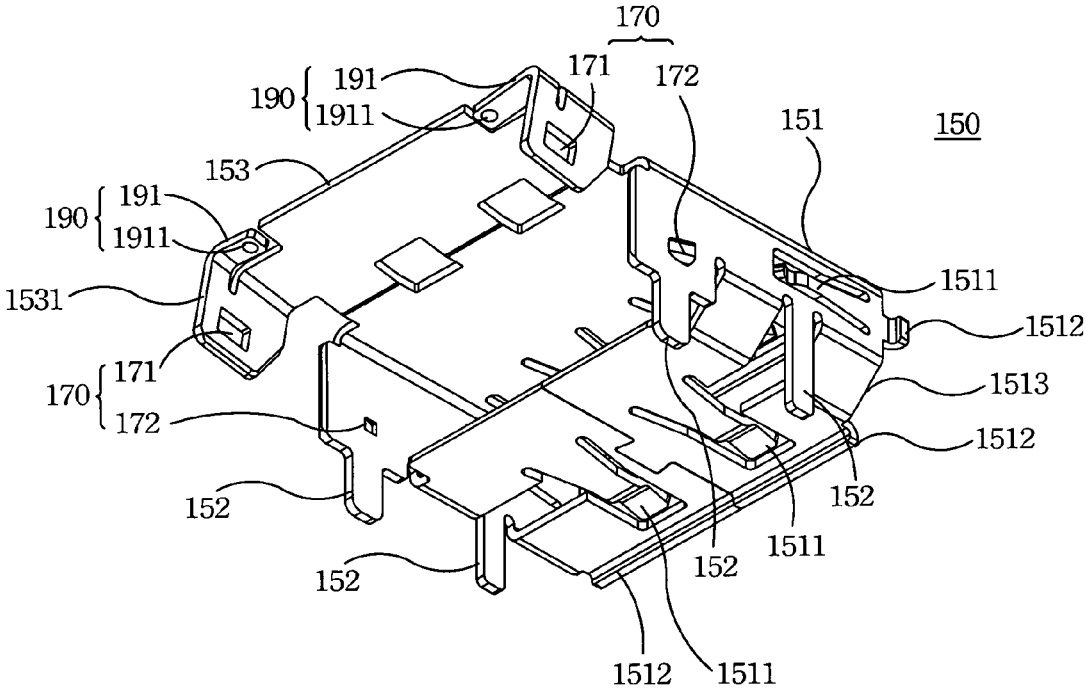
FIG. 5 is a shielding case of the electrical connector according to one embodiment of this invention.

FIG. 5 illustrates a shielding case of the electrical connector according to one embodiment of this invention. Referring to FIG. 5, the shielding case 150 of this embodiment comprises a body 151, a plurality of weld parts 152 and a back case 153. The body 151 is a frame formed by four boards connected with each other at the upper, lower, left and right sides. Namely, the body 151 substantially surrounds the upper, lower, left and right sides of the insulating housing 110. A plurality of flexible arms 1511 are disposed at the surfaces of the upper, lower, left and right sides of the body 151. The flexible arms 1511 touch the complementary device 300 to hold the complementary device 300 and make the shielding case 150 electrically connecting with the complementary device 300. A plurality of out-extended tracks 1512 are disposed at front ends of each upper, lower, left, and right side surface of the body 151. The out-extended tracks 1512 are directed to the corresponding surfaces of the complementary device 300 respectively to lead the complementary device 300 toward the shielding case 150 into the space. In other embodiments of the invention, a reverse piece is disposed between the right and lower surface of the body 151 to prevent from the inaccuracy or miss-insertion, which destroys the terminal sets 130 of the electrical connector 100. In practice, the flexible arm 1511, the out-extended track 1512 and the reverse piece 1513 can be adjusted in shape or amount if needed.

The weld parts 152 of this embodiment extend downwardly from the lower parts of the left and right surfaces of the body 151. By welding the weld parts 152 to a circuit board (not shown), the electrical connector 100 can be fixed on the circuit board. In practice, the weld part 152 can also extend from lower surface of the body 151. Besides, the weld part 152 can be through-hole or surface-mount types.

The back case 153 extends from the rear edge of the upper surface of the body 151 backward and is then bent downwardly and nearly perpendicularly to surround the back of the insulating housing 110. However, the strength of the back case 153 is not good enough to keep steady along. To strengthen the back case 153, a holding structure 170 is disposed between the body 151 and the back case 153 to hold the back case 153 at the rear edge of the body 151. In this embodiment, the width of the back case 153 is wider than the width of the front surface of the body 151, and when the back case 153 is bent downwardly, a part of the left and a part of the right sides of the back case 153 extend out of the body 151. Bending forward the above-mentioned extending parts of the left and right sides of the back case 153 will form two wings 1531. Therefore, the holding structure 170 fits the wings 1531. For example, holding holes 171 are disposed on the wings 1531, and holding embosses 172 are disposed at the complementary position on the body 151 to make the holding holes 171 match with the holding embosses 172. In practice, the holding holes 171 and the holding embosses 172 are disposed to match with each other. However, the holding holes 171 and the holding embosses 172 can be disposed reversely, i.e. the holding holes 171 are disposed at the complementary position on the body 151 and the holding embosses 172 are disposed on the wings 1531 (not shown on the figure). Besides, the shapes of the holding holes 171 and the holding embosses 172 can be adjusted if needed.

To provide stronger structure for stable electrical connection, strengthening treatment is needed for the shielding case of the embodiment. Referring to FIG. 5, there is an interval between the body 151 and the back case 153. If the complementary device is plugged in and push the insulating housing 110 backwardly, the strength of the electrical connector 100 would be decreased for the loose between the insulating housing 110 and the shielding case 150. Besides, the interval makes the insulating housing 110 unfixed, which causes unstable electrical connection. Since the shielding case 150 is made of metal, especially flexible metal sheet, a stopping mechanism 190 can be disposed at proper position of the shielding case 150. For example, cutting part of the left and right sides of the back case 153 and bending them forwardly to form a stopping flexible arm 191. Besides, the stopping flexible arm 191 pushes against the insulating housing 110. In detail, the stopping flexible arm 191 applies a pressing force on the back of the insulating housing 110, and the direction of the pressing force is opposite to what the complementary device 300 plugging therein. Therefore, the electrical connector 100 can be fixed to provide the stable electrical connection.

Figure 6:
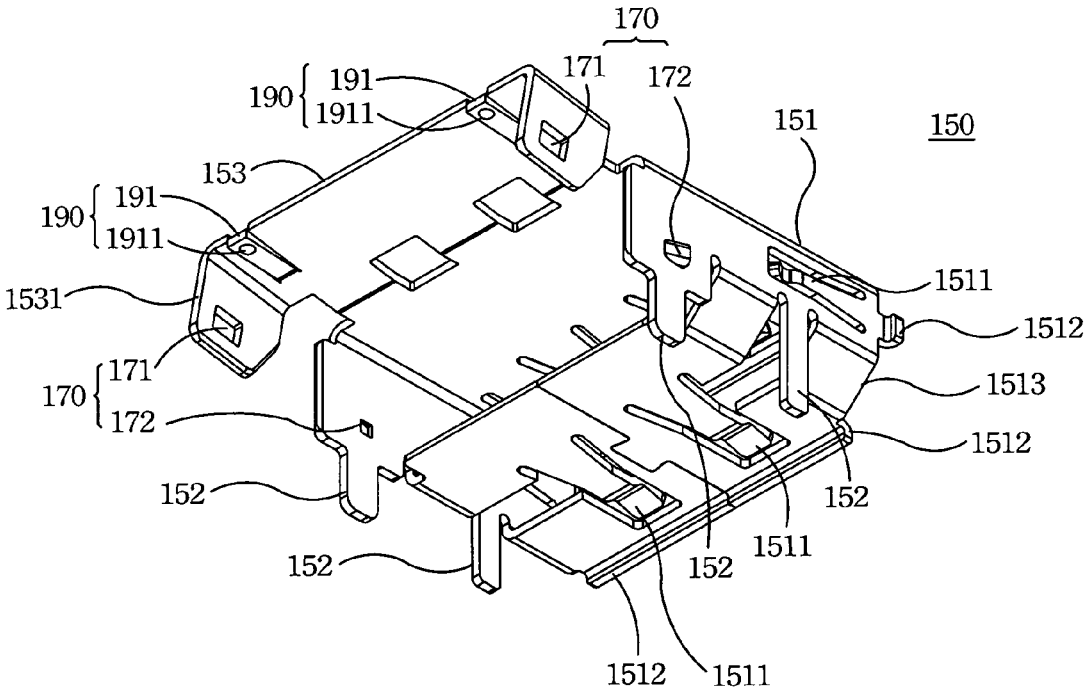
FIG. 6 is a shielding case of electrical connector according to another embodiment of this invention.

FIG. 6 illustrates the insulating case of another embodiment. Referring to FIG. 5 and FIG. 6 at the same time, a different type stopping flexible arms 191' is disclosed. For example, two stopping flexible arms 191' are formed by cutting part of the lower side of the back case 153 and bending them upwardly. The stopping flexible arms 191' also contact against the back of the insulating housing 110. In practice, the number or the position of the stopping flexible arms can be adjusted if needed. Besides, an emboss 1911 can be disposed at the end of the stopping arm 191, and another emboss 1911' can be disposed at the end of the stopping arm 1911'. The emboss 1911 and 1911' apply large pressing force by small contact area. In addition, the embosses 1911 and 1911' reduce the bending angle by the raised structure. Therefore, less material is needed for the stopping flexible arms 191 and 191', which makes the back case 153 keeping better strength with less material.

Several different advantages exist with these and other embodiments. The electrical connector of this invention comprises a stopping mechanism to cast a pressing force on the insulating housing to keep the insulating housing at the predetermined position, which leads to a tightly plug-in status. Therefore, the tightly plug-in status makes the stable electrical connection and better strength of the electrical connector's structure.

Although the present invention has been described in considerable detail with reference to certain embodiments thereof, other embodiments are possible. Therefore, their spirit and scope of the appended claims should no be limited to the description of the embodiments container herein. It will be apparent to those skilled in the art that various modifications and variations can be made to the structure or the shape of the present invention without departing from the scope or spirit of the invention. In view of the foregoing, it is intended that the present invention cover modifications and variations of this invention provided they fall within the scope of the following claims.

What is claimed is:

1. An electrical connector being adapted to be matched with a complementary device, comprising:

a plurality of terminals;

an insulating housing, disposing the terminals and having a body portion and a rear portion therein; and a shielding case, surrounding the insulating housing approximately and defining a receiving space between the insulating housing to hold at least a part of the complementary device therein, comprising:

a body, surrounding upper, lower, left, right surfaces of the insulating housing;

a back case, approximately surrounding the rear portion of the insulating housing with a holding structure holding the body portion of the insulating housing; and a stopping mechanism, formed at the back case and extending towards the insulating housing to push the insulating housing into the receiving space, wherein the stopping mechanism is a stopping flexible arm that is cut and bent forward from the back case of the shielding case to contact against the back of the insulating housing.

2. The electrical connector of claim 1, wherein the terminals comprise at least a ground terminal and two differential signal terminals connected with a plurality of corresponding complementary terminals of the complementary device.

3. The electrical connector of claim 1, wherein a plurality of flexible arms are disposed at the upper, lower, left and right surfaces of the body of the shielding case and contacting with the complementary device respectively.

4. The electrical connector of claim 1, wherein an out-extended track is disposed at each front end of the upper, lower, left and right surfaces of the body of the shielding case to lead the complementary device to the right position plugging in.

5. The electrical connector of claim 1, wherein a plurality of weld parts extend downwardly from the body of the shielding case to fix the electrical connector on a circuit board.

6. The electrical connector of claim 1, wherein the holding structure of the back of the shielding case is a holding hole, and a holding emboss is disposed at the complementary position of the body of the shielding case to fix the back of the shielding case with the body of the shielding case by matching with the holding hole.

7. The electrical connector of claim 1, wherein an emboss is disposed at the end of the stopping flexible arm for strengthening the pressing force to the insulating housing.

* * * * *